US008294536B2

(12) United States Patent
Wong

(10) Patent No.: US 8,294,536 B2
(45) **Date of Patent: *Oct. 23, 2012**

(54) CAVITY FILTER WITH A SLIDER

(75) Inventor: Kwo-Jyr Wong, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 257 days.

This patent is subject to a terminal disclaimer.

(21) Appl. No.: 12/764,969

(22) Filed: Apr. 22, 2010

(65) Prior Publication Data

US 2011/0115576 A1 May 19, 2011

(30) Foreign Application Priority Data

Nov. 13, 2009 (CN) ..... 2009 1 030968

(51) Int. Cl.
*H01P 1/20* (2006.01)

(52) U.S. Cl. ..... 333/203; 333/207

(58) Field of Classification Search ..... 333/202, 333/206, 207, 209, 203

See application file for complete search history.

(56) References Cited

U.S. PATENT DOCUMENTS

| | | | | |
|---|---|---|---|---|
| 3,863,181 | A * | 1/1975 | Glance et al. | 333/243 |
| 4,233,579 | A * | 11/1980 | Carlson et al. | 333/204 |
| 7,834,721 | B2 * | 11/2010 | Juri | 333/202 |
| 7,969,260 | B2 * | 6/2011 | Raty | 333/203 |
| 2006/0139128 | A1 * | 6/2006 | Ala-Kojola | 333/207 |
| 2009/0058563 | A1 * | 3/2009 | Seo et al. | 333/209 |

* cited by examiner

*Primary Examiner* — Seungsook Ham

(74) *Attorney, Agent, or Firm* — Altis Law Group, Inc.

(57) ABSTRACT

A cavity filter includes an enclosure, resonators secured inside the enclosure, a lid, a slider, and a driving device. The enclosure includes a bottom portion, sidewalls extending from edges of the bottom portion to define a cavity. Each sidewall defines a positioning portion at a top surface thereof. The lid covers the enclosure. The slider includes tuning cells each partially coated with metal and positioned opposite to one of the resonators. The slider is movably disposed between the lid and the resonators and slides on the positioning portions. The driving device is located inside the enclosure and drives the slider to move along the positioning portions to adjust a resonating frequency of the cavity filter.

9 Claims, 5 Drawing Sheets

CAVITY FILTER WITH A SLIDER

BACKGROUND

1. Technical Field

The disclosure relates to cavity filters, and more particularly relates to a slider of a cavity filter.

2. Description of Related Art

Cavity filters are popularly applied in mobile communications. Generally, a cavity filter comprises a lid defining threaded holes each corresponding to a tuning screw which can used in the factory to adjust a resonating frequency of the cavity filter. When the cavity filter is installed in a base station, the resonating frequency of the cavity filter is fixed, and can only be adjusted if sent back to the factory.

Therefore, a need exists in the industry to overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
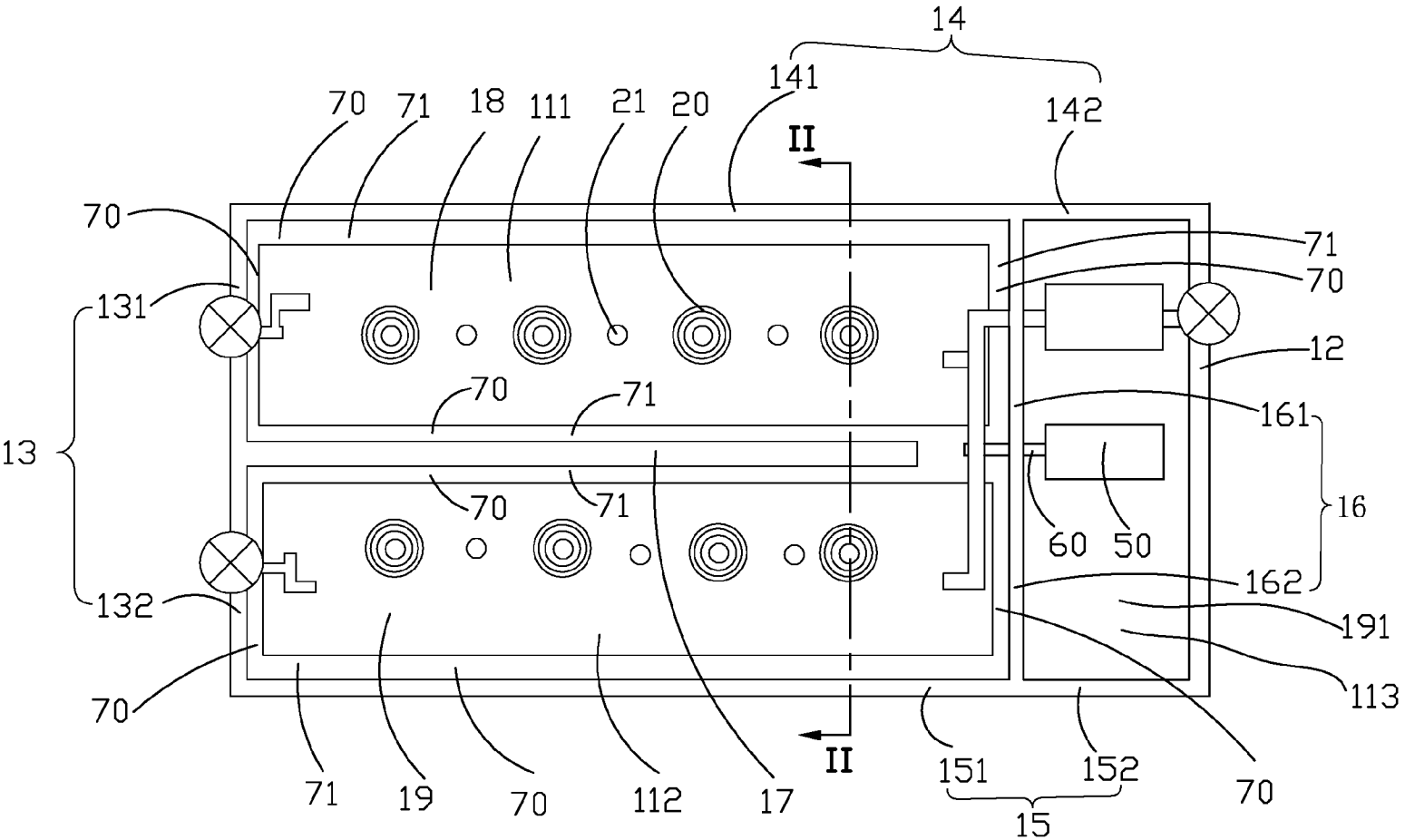
FIG. 1 is a schematic diagram of an enclosure of a cavity filter in accordance with a first exemplary embodiment of the disclosure, in which a plurality of resonators, a driving device, and a transmission device are secured in the enclosure.
Figure 2:
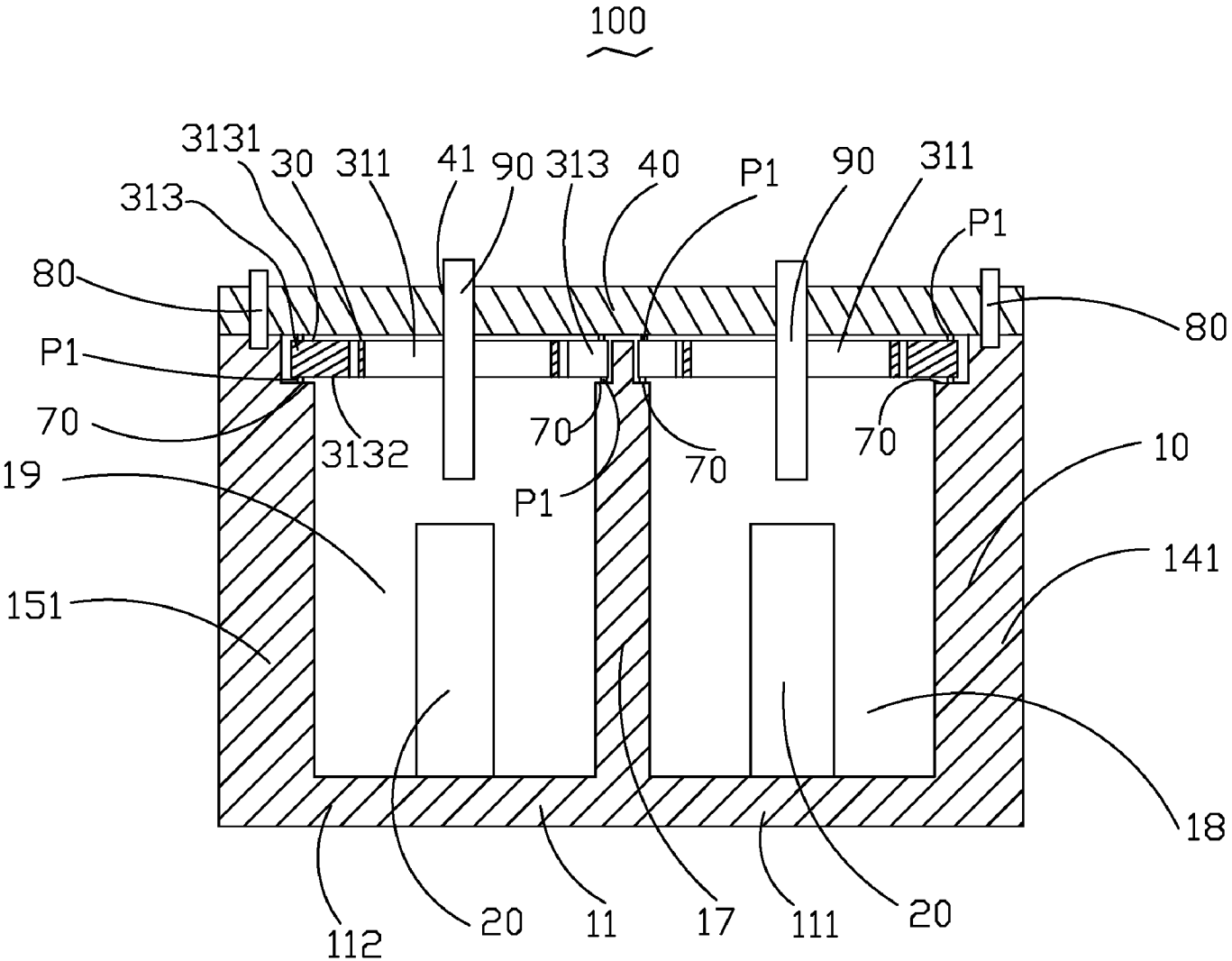
FIG. 2 is a cross-sectional view taken along line II-II of the cavity filter of FIG. 1.

With reference to FIG. 1 and FIG. 2, the cavity filter 100 comprises an enclosure 10, a plurality of resonators 20 secured in the enclosure 10, a lid 40 of the enclosure 10, a slider 30 located between the resonators 20 and the lid 40, and a driving device 50 for driving the slider 30 to slide to change a resonating frequency of the cavity filter 100.

In the embodiment, the enclosure 10 comprises a bottom portion 11, a first sidewall 12, a second sidewall 13 opposite to the first sidewall 12, a third sidewall 14, and a fourth sidewall 15 opposite to the third sidewall 14. A first partition wall 16 extends from the bottom portion 11 and perpendicularly connects to the third sidewall 14 and the fourth sidewall 15. A second partition wall 17 extends from the bottom portion 11 and perpendicularly connects to the second sidewall 13 and the first partition wall 16. In detail, a first portion 111 of the bottom portion 11, a first portion 141 of the third sidewall 14, a first portion 161 of the first partition wall 16, the second partition wall 17 and a first portion 131 of the second sidewall 13 collectively define a first cavity 18. Similarly, a second portion 112 of the bottom portion 11, a first portion 151 of the fourth sidewall 15, a second portion 162 of the first partition wall 16, the second partition wall 17, and a second portion 132 of the second sidewall 13 collectively define a second cavity 19. A third portion 113 of the bottom portion 11, the first sidewall 12, the second portion 142 of the third sidewall 14, the first partition wall 16 and a second portion 152 of the fourth sidewall 15 collectively define a third cavity 191.

Each of the first and second portions 131, 132 of the second sidewall 13, the first portion 141 of the third sidewall 14, the first portion 151 of the fourth sidewall 15, and the first and second portions 161, 162 of the first partition wall 16 define a positioning portion 70 at a top surface thereof opposite to the bottom portion 11. The second partition wall 17 defines a pair of positioning portions 70 at two sides of a top surface thereof, respectively. In other words, each of the first cavity 18 and the second cavity 19 is configured with four positioning portions 70 located at top surfaces of walls defining the cavities 18 and 19. The positioning portions 70 are configured to collectively support the slider 30. In the embodiment, each positioning portion 70 is a step comprising a supporting surface 71 to support the slider 30. The supporting surface 71 of each positioning portion 70 is parallel to the bottom portion 11 of the enclosure 10 and perpendicular to an inner surface of a corresponding wall.

The plurality of resonators 20 are secured inside the enclosure 10. In the embodiment, four resonators 20 are secured in each of the first and second cavities 18, 19. A coupling zone 21 is formed between each two adjacent resonators 20 to adjust a coupling frequency of the cavity filter 100.

Figure 3:
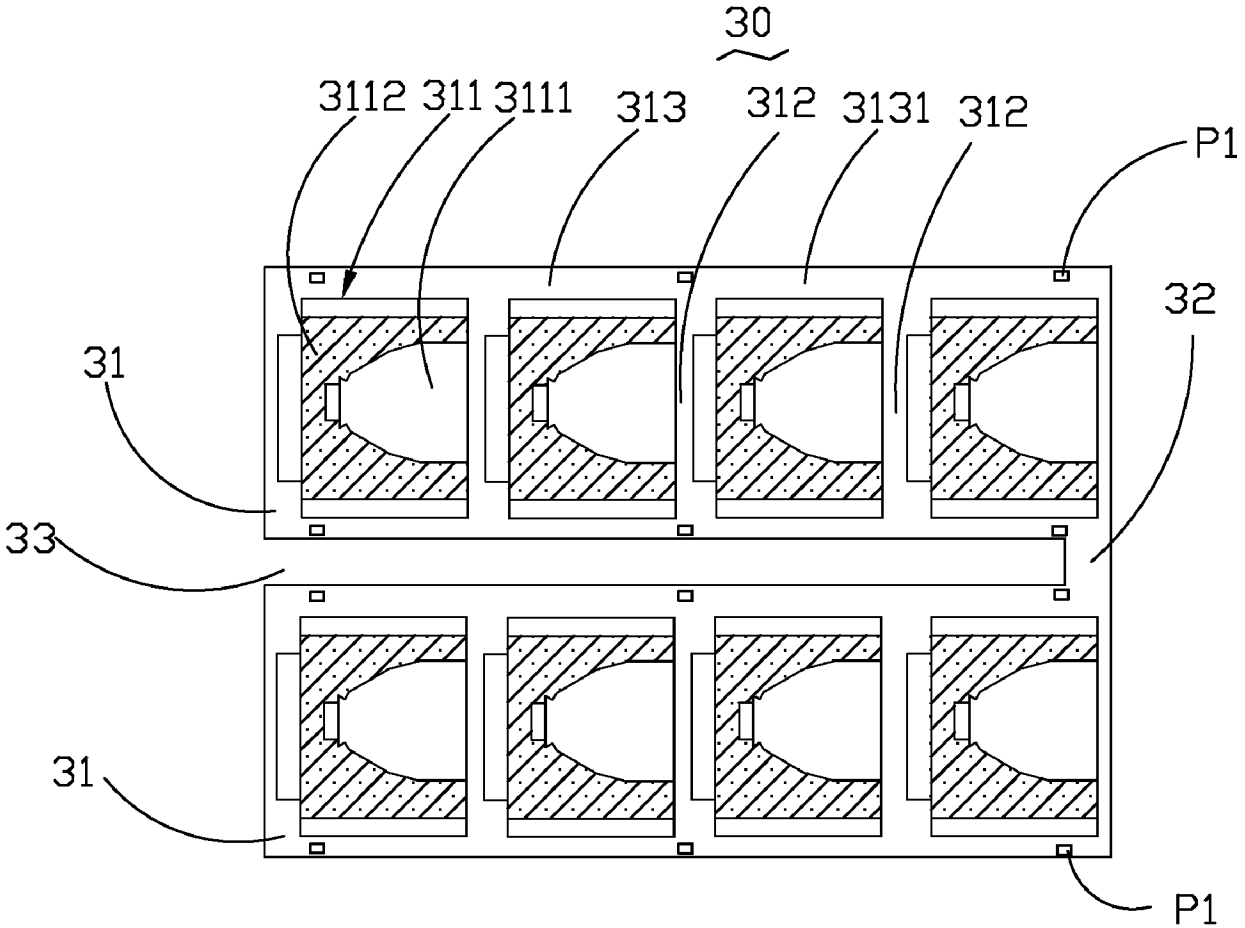
FIG. 3 is a schematic diagram of a slider of FIG. 2.

With reference to FIG. 3, in the embodiment, the slider 30 comprises two sliding elements 31 corresponding to the first cavity 18 and the second cavity 19, respectively. Each sliding element 31 comprises a plurality of tuning cells 311, a plurality of first connection portions 312 between each two adjacent tuning cells 311, and a frame 313 surrounding the plurality of tuning cells 311. The two sliding elements 31 are connected by a second connection portion 32. Each of the plurality of tuning cells 311 comprises a metal tuning portion 3112 defining a through hole 3111 corresponding to one of the plurality of the resonators 20. In the embodiment, the metal tuning portion 3112 is coated with copper, and the trough hole of each of the plurality of tuning cells is in the shape of half of an ellipse.

In the embodiment, the frame 313 of each sliding element 31 comprises a top surface 3131 and a bottom surface 3132. A plurality of nipples P1 are configured on the top surface 3131 and the bottom surface 3132. In the embodiment, the frame 313, the first connection portion 312, and the second connection portion 32 are all made of plastic. In assembly, each sliding element 31 is positioned on corresponding positioning portions 70 of a corresponding cavity. In this position, the tuning cells 311 of each sliding element 31 correspond to the resonators 20 of the corresponding cavity respectively. The nipples P1 on the bottom surface 3132 contact with the supporting surfaces 71 of the positioning portions 70, and the nipples P1 on the top surface 3131 contact with a bottom surface of the lid 40. In this way, the friction existing between the sliding elements 31 and the positioning portions 70 is reduced, and the sliding elements 31 are more easily moved.

The lid 40 covers the enclosure 10 and is fixed on the enclosure 10 by screws 80. The lid 40 defines a plurality of threaded holes 41 each matched with a tuning screw 90 corresponding to the resonators 20 respectively, providing a means of adjusting a resonating frequency of the cavity filter 100.

The driving device 50 is received in the third cavity 191. In the embodiment, the driving device 50 is a step motor, and the slider 30 is connected to the step motor 50 by a transmission device 60, such as a ball screw. In use, the driving device 50 drives the slider 30 to move along the supporting surfaces 71 of the positioning portions 70 to adjust the resonating frequency of the cavity filter 100.

Figure 4:
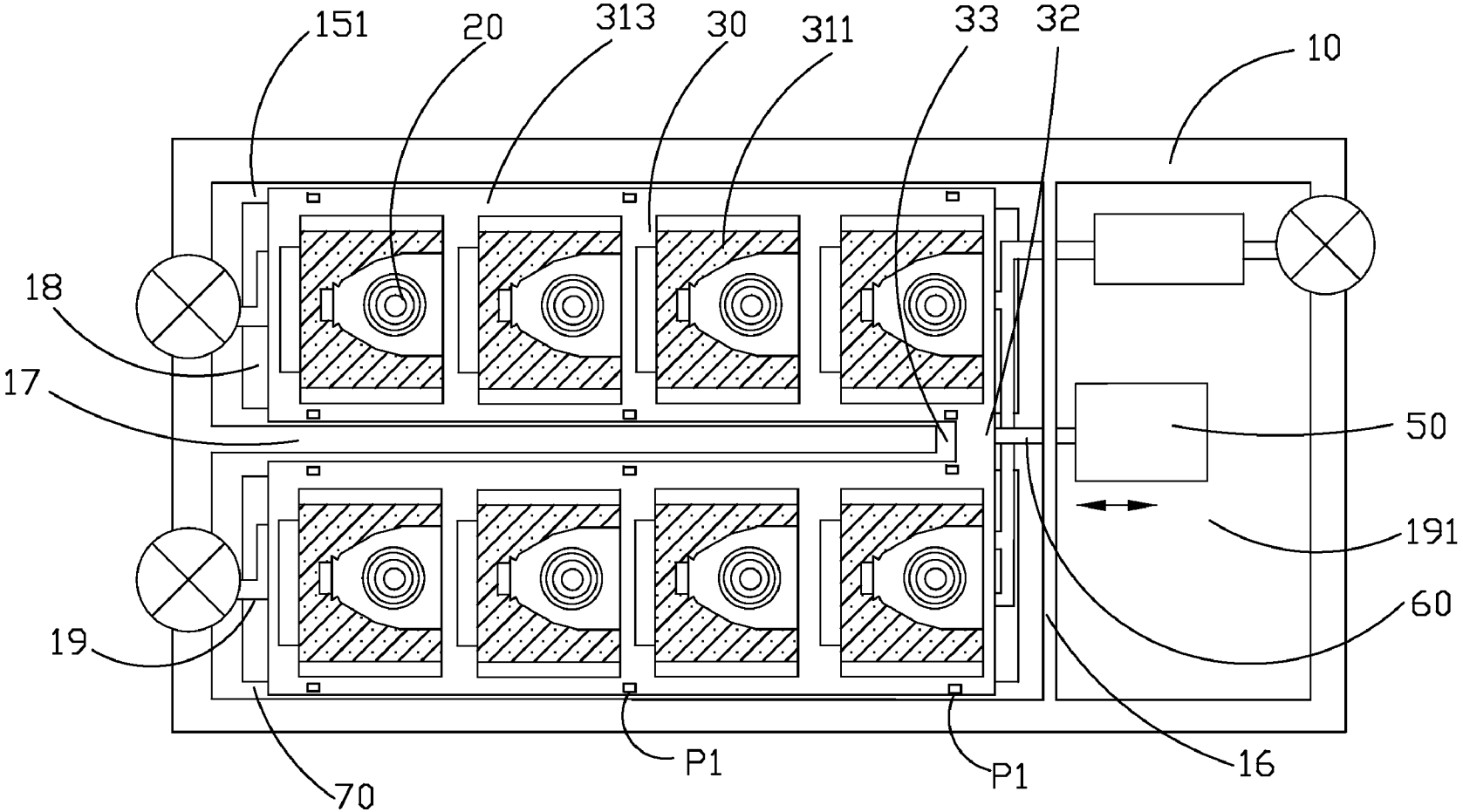
FIG. 4 illustrates a schematic diagram of one position of the slider of FIG. 3 mounted in the enclosure of the cavity filter of FIG. 1.

With reference to FIG. 4, in assembly, the frame 313 of each sliding element 31 is movably positioned on the supporting surfaces 71 of the positioning portions 70 of the corresponding cavity. The driving device 50 is received in the third cavity 191, and one end of the transmission device 60 is connected to the driving device 50, and the other end extends through the first partition wall 16 to connect to the second connection portion 32 of the slider 30. The lid 40 covers the enclosure 10 and is fixed on the enclosure 10 by the screws 80. In this position, the slider 30 is movably disposed between the lid 40 and the resonators 20, and can move along the positioning portions 70 under control of the driving device 50. The nipples P1 on the bottom surface 3132 of the slider 30 contact with the supporting surfaces 71 of the positioning portions 70, and the nipples P1 on the top surface 3131 contact with the bottom surface of the lid 40, for less friction during sliding of the slider 30, so that the driving device 50 can control the slider 30 to slide easily and precisely.

When changing the resonating frequency of the cavity filter 100 in a base station, the driving device 50 drives the slider 30 to move along the positioning portions 70. As a result, a first relative position between the lid 40 and the slider 30 and a second relative position between the tuning cells 311 and the resonators 20 are changed, which results in change of capacitance between the lid 20 and the resonators 20, such that the resonating frequency of the cavity filter 100 is changed.

Figure 5:
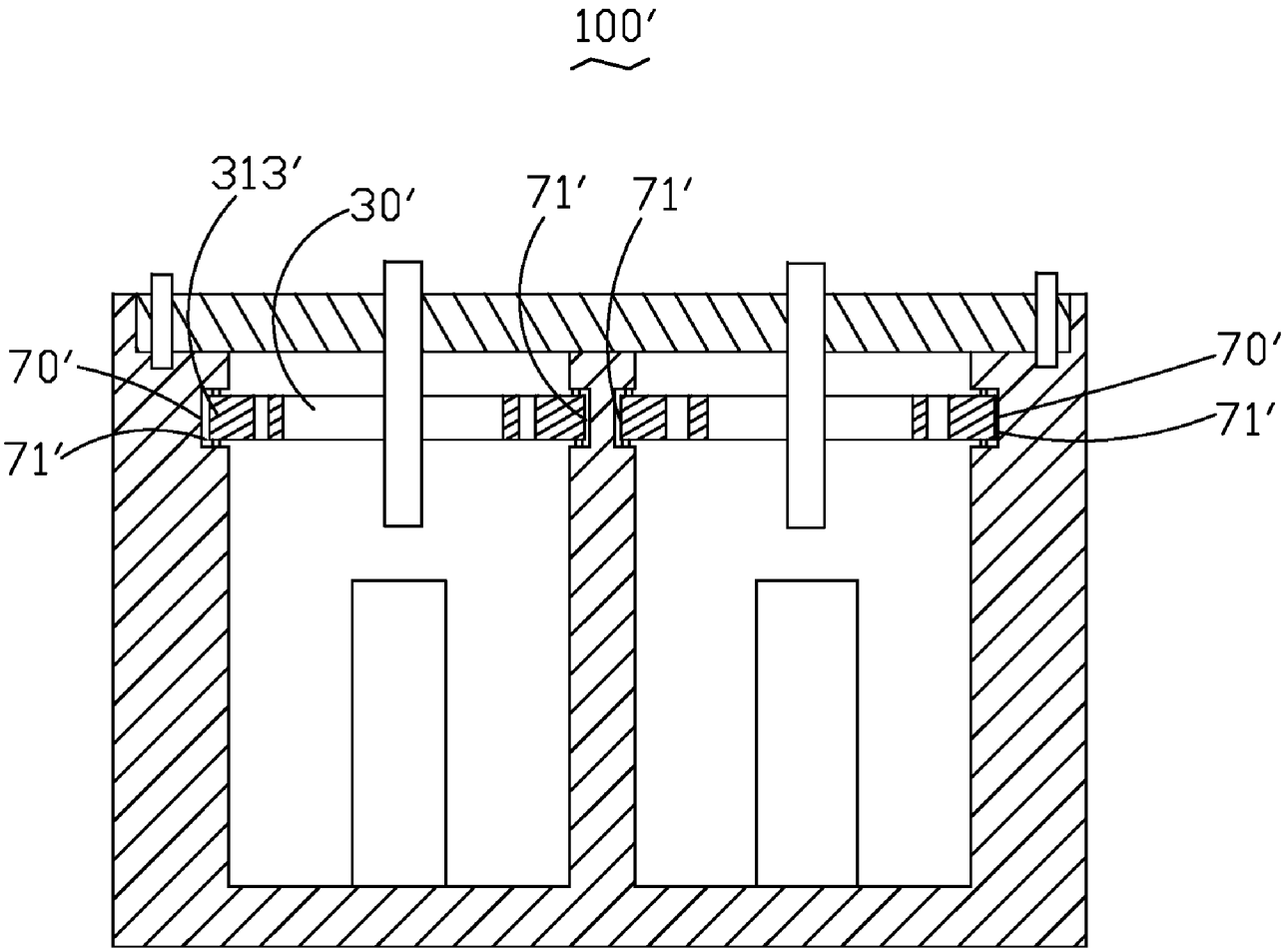
FIG. 5 is a cross sectional view of a cavity filter in accordance with a second exemplary embodiment of the disclosure.

FIG. 5 is a schematic diagram of a cavity filter 100' in accordance with a second exemplary embodiment of the disclosure. The cavity filter 100' has the same configuration and can perform the same function as the cavity filter 100 shown in FIG. 2, differing only in that each of positioning portions 70' of the cavity filter 100' is a groove 71' instead of the steps 70 of the cavity filter 100, and frames 313' of a slider 30' are received and slide in the grooves 71', respectively.

While the exemplary embodiments have been described, it should be understood that it has been presented by way of example only and not by way of limitation. The breadth and scope of the disclosure should not be limited by the described exemplary embodiments, but only in accordance with the following claims and their equivalent.

What is claimed is:

1. A cavity filter, comprising:

an enclosure comprising a bottom portion, a plurality of sidewalls extending from edges of the bottom portion, each sidewall defining a positioning portion at a top surface opposite to the bottom portion of the enclosure;

a plurality of resonators each secured inside the enclosure;

a lid covering the enclosure and defining a plurality of thread holes each matched with a tuning screw corresponding to the plurality of resonators, respectively, providing adjustment of a resonating frequency of the cavity filter;

a slider movably disposed between the lid and the positioning portions, the slider comprising a plurality of tuning cells corresponding to the plurality of resonators, respectively, each of the plurality of tuning cells comprising a metal tuning portion defining a through hole, wherein the slider comprises a frame surrounding the plurality of tuning cells and positioned on the positioning portions, and the frame comprises a top surface and a bottom surface, and wherein a plurality of nipples are configured on the top surface and the bottom surface correspondingly; and a driving device located inside the enclosure to drive the slider to move along the positioning portions to adjust the resonating frequency of the cavity filter.

2. The cavity filter as claimed in claim 1, wherein the driving device is a step motor.

3. The cavity filter as claimed in claim 1, wherein each positioning portion is a step, wherein the step comprises a supporting surface parallel to the bottom portion of the enclosure and perpendicular to an inner surface of a corresponding wall.

4. The cavity filter as claimed in claim 1, wherein each positioning portion is a groove defined in a corresponding wall to receive the frame of the slider.

5. The cavity filter as claimed in claim 1, wherein the through hole of each of the plurality of tuning cells is in the shape of half of an ellipse.

6. A cavity filter, comprising:

an enclosure comprising a bottom portion, a plurality of sidewalls extending from edges of the bottom portion, each sidewall defining a positioning portion at a top surface opposite to the bottom portion of the enclosure;

a plurality of resonators each secured inside the enclosure;

a lid covering the enclosure and defining a plurality of thread holes each matched with a tuning screw corresponding to the plurality of resonators, respectively, providing adjustment of a resonating frequency of the cavity filter;

a slider movably disposed between the lid and the positioning portions, the slider comprising a plurality of tuning cells partially coated with metal and corresponding to the plurality of resonators, respectively, wherein the slider comprises a frame surrounding the plurality of tuning cells and comprises a top surface and a bottom surface, and a plurality of nipples are configured on the top surface and the bottom surface correspondingly; and a driving device located inside the enclosure to drive the slider to move along the positioning portions to adjust the resonating frequency of the cavity filter.

7. The cavity filter as claimed in claim 6, wherein the driving device is a step motor.

8. The cavity filter as claimed in claim 6, wherein each positioning portion is a step, wherein the step comprises a supporting surface parallel to the bottom portion of the enclosure and perpendicular to an inner surface of a corresponding wall.

9. The cavity filter as claimed in claim 6, wherein each positioning portion is a groove defined in a corresponding wall to receive the frame of the slider.

* * * * *

UNITED STATES PATENT AND TRADEMARK OFFICE

CERTIFICATE OF CORRECTION

PATENT NO. : 8,294,536 B2
APPLICATION NO. : 12/764969
DATED : October 23, 2012
INVENTOR(S) : Kwo-Jyr Wong It is certified that error appears in the above-identified patent and that said Letters Patent is hereby corrected as shown below:

On the Title page replace item (30) "Foreign Application Priority Data" as follows:

(30) Foreign Application Priority Data

Nov. 13, 2009 (CN) .....200910309681.9

Signed and Sealed this
Fifth Day of November, 2013

Teresa Stanek Rea

Teresa Stanek Rea
*Deputy Director of the United States Patent and Trademark Office*